United States Patent [19]

Kampfer et al.

[11] Patent Number: 4,987,063

[45] Date of Patent: Jan. 22, 1991

[54] GRADATION VARIABLE BLACK- AND -WHITE PAPER

[75] Inventors: Helmut Kampfer, Cologne; Walter Pätzold, Leverkusen; Günther Mahlberg, Bergisch-Gladbach, all of Fed. Rep. of Germany

[73] Assignee: AGFA-Gevaert Aktiengesellschaft, Leverkusen, Fed. Rep. of Germany

[21] Appl. No.: 269,564

[22] Filed: Nov. 10, 1988

[30] Foreign Application Priority Data

Nov. 24, 1987 [DE] Fed. Rep. of Germany ..... 37397834

[51] Int. Cl.[5] ..... G03C 1/19

[52] U.S. Cl. ..... 430/550; 430/571; 430/588

[58] Field of Search ..... 430/550, 571, 588

[56] References Cited

U.S. PATENT DOCUMENTS

| | | | |
|---|---|---|---|
| 2,384,598 | 9/1945 | Carroll | 430/571 |
| 4,659,654 | 4/1987 | Metoki et al. | 430/567 |
| 4,791,053 | 12/1988 | Ogawa | 430/581 |

*Primary Examiner*—Paul R. Michl
*Assistant Examiner*—Janis L. Dote
*Attorney, Agent, or Firm*—Connolly & Hutz

[57] ABSTRACT

A gradation variable black-and-white paper containing only one light sensitive silver halide emulsion layer in which transfer of sensitization is prevented may be obtained by sensitization with at least one compound corresponding to the following formula

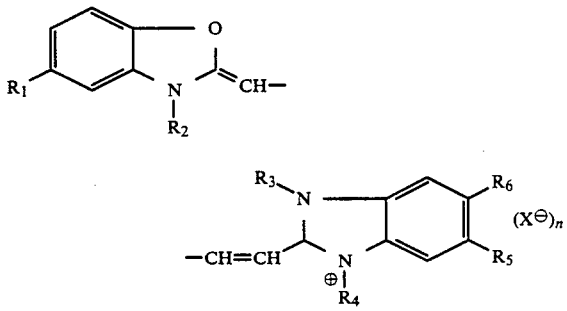

in which at least one of the groups $R_1$, $R_5$ or $R_6$ is halogen.

4 Claims, No Drawings

GRADATION VARIABLE BLACK- AND -WHITE PAPER

This invention relates to a gradation variable black-and-white paper containing at least one emulsion which is sensitive in the green and the blue region of the spectrum and in which a wider exposure range is obtained by exposure in the green region than in the blue region.

Gradation variable light sensitive silver halide materials contain emulsions which are sensitive to light of different regions of the spectrum. The gradation obtained may be harder or softer, depending on the composition of the copying light. The emulsions are normally mixed before casting so that only one layer need be cast. There is therefore a risk of transfer of sensitization, i.e. the sensitizing dye may be desorbed from the silver halide grains of one emulsion and absorbed by the grains of a blue sensitive emulsion which has not been sensitized. This is undesirable because differential exposure by altering the copying light will then no longer produce the desired result. Under unfavourable conditions, transfer of sensitization is not limited to the casting solution but may also occur in the finished material, e.g. under the action of heat or moisture or both.

To prevent transfer of sensitization requires elaborate precautions, for example storage of the finished material under special conditions or reduction of the residence time of the finished casting solution. Since these adverse effects cannot always be eliminated by the manufacturer, there has been no lack of attempts to develop methods of preventing sensitization transfer. Thus it has been proposed to remove excess sensitizing dye (DL-PS No. 7210), not to exceed certain critical temperatures when mixing and casting the solution (US-Pat.No. 2,367,508), to avoid leaving the casting solutions to stand for long periods (GB-PS No. 540 451, DE-OS No.2 426 676), to add metal compounds to the casting solutions to prevent diffusion of the sensitizing dyes (U.S.-Pat. No. 2,336,260) and not to mix emulsions which differ in their sensitization with one another or with unsensitized emulsions but to cast them separately above one another (GB-PS No.541 515 and FR-PS No. 2 251 837).

It has also been proposed to prevent sensitization transfer by greatly reducing the quantity of sensitizer (U.S.-Pat. No. 2,280,300) and by mixing emulsions of different silver halide compositions (DE-PS No.1 597 476).

None of these measures has provided a satisfactory solution to the problem in that it has not been possible to eliminate sensitization transfer during storage of the finished material, preparation of the material was greatly increased in cost by the multiple casting procedure, reduction in the quantity of dye led to sensitivity differences and changes in the halide composition resulted in differences in image tone.

It was therefore an object of the present invention to provide a process in which spectral green sensitization free from the disadvantages described above could be used for the preparation of a gradation variable black-and-white paper.

It has now been found that this problem may be solved by sensitizing an emulsion with particular quantities of a special green sensitizer.

This invention therefore relates to a gradation variable black and white paper containing a light sensitive silver halide emulsion layer, characterised in that the silver halide is green sensitized with at least one compound corresponding to formula (I)

(I)

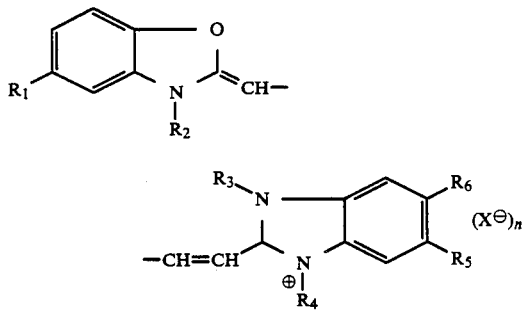

wherein $R_1$ denotes hydrogen, halogen, alkyl or alkoxy,
$R_2$ denotes alkyl, sulphoalkyl or carboxyalkyl,
$R_3$ denotes alkyl, hydroxyalkyl, or acyloxyalkyl,
$R_4$ denotes alkyl, sulphoalkyl or carboxyalkyl,
$R_5$ denotes halogen, cyano, aminocarbonyl, trifluoromethyl or alkoxycarbonyl,
$R_6$ denotes hydrogen or $R_5$,
$X^-$ denotes an anion and
n stands for 0 or 1, and at least one of the groups $R_1$, $R_5$ and $R_6$ is halogen, n stands for 0 when one of the groups denoted by $R_2$ or $R_4$ is a sulphoalkyl or a carboxyalkyl group and n stands for 1 when neither of the groups denoted by $R_2$ and $R_4$ is a sulpho-alkyl or a carboxyalkyl group in a quantity of from $$\frac{10}{\bar{d}} \text{ to } \frac{80}{\bar{d}} \ \mu\text{mol/mol}$$

of silver halide, where $\bar{d}$ is the average grain diameter of the silver halide in $\mu$m.

The alkyl, sulphoalkyl, carboxyalkyl, hydroxyalkyl and acyloxyalkyl groups have in particular 1 to 6 carbon atoms in the alkyl portion. The term "acyl" preferably stands for $C_1$ to $C_4$ alkylcarbonyl. Halogen is preferably chlorine. Alkoxy and alkoxycarbonyl may in particular have 1 to 4 carbon atoms in the alkoxy portion.

The anions may be halides such as chloride or bromide or sulphates or alkyl sulphate such as methosulphate or ethosulphate, or they may be perchlorate or p-toluene sulphonate.

Suitable compounds corresponding to formula I are shown in the following Table 1.

TABLE I

| | $R_1$ | $R_2$ | $R_3$ | $R_4$ | $R_5$ | $R_6$ | $X^\ominus$ | n |
|---|---|---|---|---|---|---|---|---|
| 1 | Cl | $CH_3$ | $C_2H_5$ | $(CH_2)_3—SO_3^\ominus$ | Cl | H | — | 0 |
| 2 | Cl | $CH_3$ | $C_2H_5$ | $(CH_2)_4—SO_3^\ominus$ | Cl | H | — | 0 |
| 3 | Cl | $CH_3$ | $C_2H_5$ | $(CH_2)_2—CH(CH_3)—SO_3^\ominus$ | Cl | H | — | 0 |
| 4 | Cl | $C_2H_5$ | $C_2H_5$ | $(CH_2)_3—SO_3^\ominus$ | Cl | H | — | 0 |
| 5 | Cl | $C_2H_5$ | $C_2H_5$ | $(CH_2)_4—SO_3^\ominus$ | Cl | H | — | 0 |
| 6 | Cl | $C_2H_5$ | $C_2H_5$ | $(CH_2)_2—CH(CH_3)—SO_3^\ominus$ | Cl | H | — | 0 |
| 7 | Cl | $C_2H_5$ | $CH_3$ | $(CH_2)_3—SO_3^\ominus$ | Cl | H | — | 0 |

TABLE I-continued

| | $R_1$ | $R_2$ | $R_3$ | $R_4$ | $R_5$ | $R_6$ | $X^{\ominus}$ | n |
|---|---|---|---|---|---|---|---|---|
| 8 | Cl | $C_2H_5$ | $CH_3$ | $(CH_2)_4—SO_3^{\ominus}$ | Cl | H | — | 0 |
| 9 | Cl | $(CH_2)_3—SO_3^{\ominus}$ | $CH_3$ | $C_2H_5$ | Cl | H | — | 0 |
| 10 | Cl | $(CH_2)_4—SO_3^{\ominus}$ | $CH_3$ | $C_2H_5$ | Cl | H | — | 0 |
| 11 | Cl | $(CH_2)_3—SO_3^{\ominus}$ | $CH_3$ | $CH_3$ | Cl | H | — | 0 |
| 12 | Cl | $(CH_2)_4—SO_3^{\ominus}$ | $CH_3$ | $CH_3$ | Cl | H | — | 0 |
| 13 | Cl | $(CH_2)_3—SO_3^{\ominus}$ | $C_2H_5$ | $C_2H_5$ | Cl | H | — | 0 |
| 14 | Cl | $(CH_2)_2—CH(CH_3)—SO_3^{\ominus}$ | $C_2H_5$ | $C_2H_5$ | Cl | H | — | 0 |
| 15 | Cl | $(CH_2)_4—SO_3^{\ominus}$ | $C_2H_5$ | $C_2H_5$ | Cl | H | — | 0 |
| 16 | Cl | $C_2H_5$ | $CH_3$ | $CH_3$ | Cl | H | $CH_3SO_4^{\ominus}$ | 1 |
| 17 | $CH_3$ | $C_2H_5$ | $CH_3$ | $CH_3$ | Cl | H | $CH_3SO_4^{\ominus}$ | 1 |
| 18 | $CH_3$ | $C_2H_5$ | $CH_3$ | $C_2H_5$ | Cl | H | $I^{\ominus}$ | 1 |
| 19 | Cl | $CH_3$ | $C_2H_5$ | $(CH_2)_4—SO_3^{\ominus}$ | Cl | Cl | — | 0 |
| 20 | Cl | $CH_3$ | $C_2H_5$ | $(CH_2)_2—CH(CH_3)—SO_3^{\ominus}$ | Cl | Cl | — | 0 |
| 21 | Cl | $CH_3$ | $C_2H_5$ | $(CH_2)_3—SO_3^{\ominus}$ | Cl | Cl | — | 0 |
| 22 | Cl | $CH_3$ | $CH_3$ | $(CH_2)_4—SO_3^{\ominus}$ | Cl | Cl | — | 0 |
| 23 | Cl | $CH_3$ | $CH_3$ | $(CH_2)_2—CH(CH_3)—SO_3^{\ominus}$ | Cl | Cl | — | 0 |
| 24 | Cl | $(CH_2)_3—SO_3^{\ominus}$ | $CH_3$ | $CH_3$ | Cl | Cl | — | 0 |
| 25 | Cl | $(CH_3)_3—SO_3^{\ominus}$ | $C_2H_5$ | $CH_3$ | Cl | Cl | — | 0 |
| 26 | Cl | $C_2H_5$ | $CH_3$ | $CH_3$ | Cl | Cl | $CH_3SO_4^{\ominus}$ | 1 |
| 27 | H | $C_2H_5$ | $CH_3$ | $(CH_2)_3—SO_3^{\ominus}$ | Cl | Cl | — | 0 |
| 28 | H | $(CH_2)_3—SO_3^{\ominus}$ | $CH_3$ | $C_2H_5$ | Cl | Cl | — | 0 |
| 29 | $CH_3$ | $(CH_2)_3—SO_3^{\ominus}$ | $CH_3$ | $C_2H_5$ | Cl | Cl | — | 0 |
| 30 | $CH_3$ | $(CH_2)_3—SO_3^{\ominus}$ | $CH_3$ | $C_2H_5$ | Cl | Cl | — | 0 |
| 31 | Cl | $(CH_2)_3—SO_3^{\ominus}$ | $C_2H_5$ | $C_2H_5$ | CN | H | — | 0 |

In one particular embodiment of the invention, the green sensitizers are added to only part of the emulsion, in particular to 20 to 80% by weight thereof. In another embodiment of the invention, the gradation variable black-and-white paper contains a mixture of at least one emulsion containing at least one green sensitizer according to the invention and at least one emulsion sensitized to the blue region of the spectrum (in the region of 420 to 480 μm). The quantity of blue sensitized emulsion may in particular be 15 to 60% by weight. These measures result in particularly advantageous gradation differentiation.

Dyes corresponding to the following formulae are suitable as blue sensitizers:

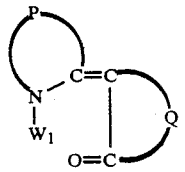

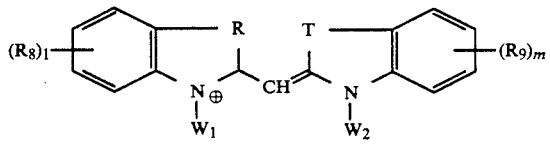

wherein

P denotes the members required for completing an optionally benzo-condensed heterocyclic five membered ring, Q denotes the ring members required for completing a rhodanine, thiohydantoin, thio-oxazolidone or thiobarbituric acid ring, $W_1$ and $W_2$ denote $C_1$ to $C_4$ alkyl optionally substituted by hydroxy, carboxy or sulpho, 1 and m stand for 0, 1 or 2, R and T stand for 0, S or N—$R_7$, $R_7$ denotes $C_1$ to $C_4$ alkyl optionally substituted by hydroxy, carboxy or sulpho, and $R_8$ and $R_9$ denote $CH_3$, $CH_3O$ or halogen or when R or T is oxygen they may denote phenyl.

The heterocyclic ring completed by P are preferably pyrroline, oxazole, imidazole, thiazole or selenazole or their benzo condensed derivatives or 1,3,4-thiadiazole which may be substituted by $C_1$ to $C_4$ alkyl, $C_1$ to $C_4$ alkoxy, cyanogen, halogen or aryl, in particular phenyl, $C_1$ to $C_4$ alkylthio, carb-$C_1$ to $C_4$-alkoxy-$C_1$ to $C_4$-alkylthio, carboxy-$C_1$ to $C_4$-alkylthio, sulpho-$C_1$ to $C_4$-alkyl or sulphoaryl, especially sulphophenyl.

The heterocyclic rings completed by Q may be substituted by $C_1$ to $C_5$ alkyl or by aryl, in particular phenyl, and the aryl may in turn be substituted, preferably by carboxy or sulpho.

The quantity of blue sensitizer used is not critical but is preferably from 10 to 300 μmol/mol Ag, in particular from 20 to 150 μmol.

The following dyes are particularly suitable:

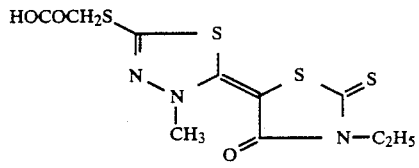

BS1

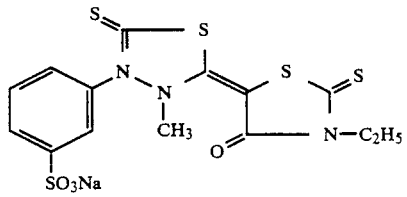

BS2

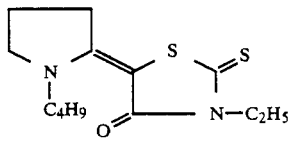

BS3

-continued

BS4

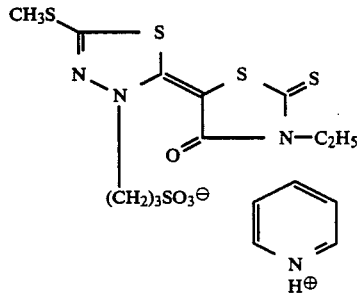

BS5

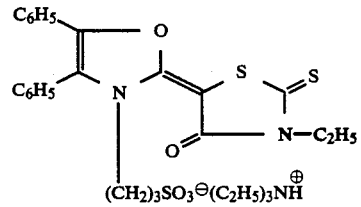

BS6

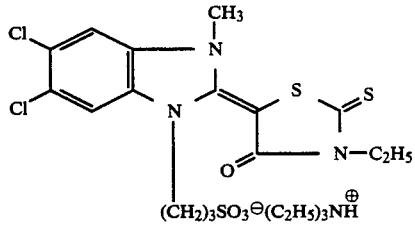

BS7

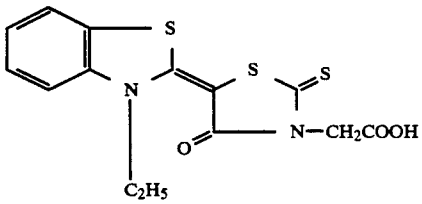

BS8

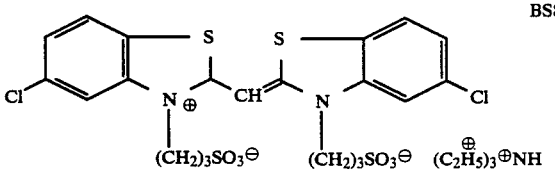

BS9

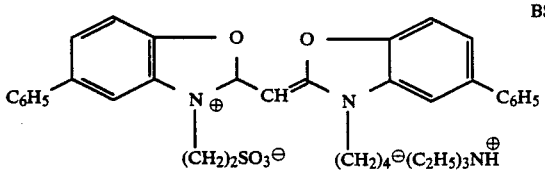

BS10

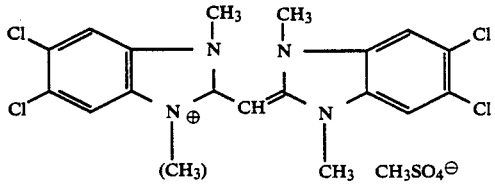

The average particle size of the silver halide grains is preferably from 0.2 to 0.6 μm, especially from 0.4 to 0.5 μm.

The silver halide may in particular be composed of 20 to 80 mol % of AgBr, 80 to 20 mol % of AgCl and 0 to 5 mol % of AgI.

The silver halide crystals may be doped with $Rh^{3+}$, $Ir^{4+}$, $Cd^{2+}$, $Zn^{2+}$ or $Pb^{2+}$.

Desalting of the emulsion may be carried out by the conventional methods (dialysis, flocculation and redispersion, ultra-filtration).

An essential component of the one or more than one light sensitive layer apart from silver halide is the binder.

The binder used is preferably gelatine but this may be partly or completely replaced by other synthetic, semi-synthetic or naturally occurring polymers. Examples of synthetic gelatine substitutes are polyvinyl alcohol, poly-N-vinylpyrrolidone, polyacrylamides and polyacrylic acid and their derivatives, in particular their copolymers. Examples of naturally occurring gelatine substitutes include other proteins such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose and gelatine derivatives obtained by the reaction of gelatine with alkylating or acylating agents or by the grafting of polymerisable monomers are examples of such materials.

The binders should have a sufficient quantity of functional groups so that sufficiently resistant layers may be obtained by the reaction with suitable hardeners. The main functional groups of this type are amino groups but carboxyl groups, hydroxyl groups and active methylene groups are also suitable.

Gelatine, which is the preferred binder, may be obtained by acid or alkaline decomposition. The preparation of such gelatines is described, for example, in the Science and Technology of Gelatine, published by A. G. Ward and A. Courts, Academic Press 1977, pages 295 et sec. The gelatine used should be as free as possible from photographically active impurities (inert gelatine). Gelatines with a high viscosity and low swelling are particularly advantageous.

The silver halide present as light sensitive component of the photographic material may consist of predominantly compact crystals which may be, for example, in the form of regular cubes or octahedrons or they may have transitional forms but the silver halide may advantageously also contain platelet shaped crystals in which the average ratio of diameter to thickness is preferably greater than 5:1, the diameter of a grain being defined as the diameter of a circle having a surface area equal to the projected area of the grain.

The silver halide grains may also have a multilayered grain structure, in the simplest case with an inner and an outer region (core/shell) which differ in their halide composition and/or other modifications such as doping of the different regions of the grain. The grain size distribution may be either homodisperse or heterodisperse. Homodisperse grain size distribution means that 95% of the grains deviate by not more than ±30% from the average grain size. The emulsions may contain organic silver salts in addition to the silver halide, e.g. silverbenzotriazolate or silverbehenate.

Two or more types of separately prepared silver halide emulsions may be used as a mixture.

The photographic emulsions may be prepared by various methods (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsions, The Focal Press, London (1966)) from soluble silver salts and soluble halides.

Precipitation of the silver halide is preferably carried out in the presence of the binder, e.g. the gelatine, and may be carried out in an acid, neutral or alkaline pH, preferably with the additional use of silver halide complex formers such as, for example, ammonia, thioethers, imidazole, ammonium thiocyanate or excess halide. The water soluble silver salts and the halides may be brought together successively by the single jet process or simultaneously by the double jet process or by any combination of the two processes. It is preferred to employ a method of dosing at increasing supply rates, but not exceeding the "critical" supply rate at which the formation of new nuclei is just still prevented. The pAg range during precipitation may vary within wide limits and it is preferable to employ the so called pAg-controlled process in which the pAg is kept constant at a certain value or made to pass through a certain profile in the course of precipitation. Instead of the preferred method of precipitation with an excess of silver halide, the so called inverse method of precipitation with an excess of silver ions may be employed. The silver halide crystals may be made to grow not only by precipitation but also by physical ripening (Ostwald ripening) in the presence of excess halide and/or silver halide complex forming agents. Growth of the emulsion grains may in fact take place predominantly by Ostwald ripening, in which case a fine grained, so called Lippmann emulsion is preferably mixed with a sparingly soluble emulsion and redissolved and precipitated on the latter.

The photographic emulsions may contain compounds to prevent fogging or to stabilize the photographic function during production, storage or photographic processing.

Azaindenes are particularly suitable, especially tetra and penta azaindenes, in particular those which are substituted with hydroxyl or amino groups. Compounds of this type are described e.g. by Birr in Z Wiss Phot. 47 (1952), pages 2 to 58. Salts of metals such as mercury or cadmium, aromatic sulphonic or sulphinic acids such as benzene sulphinic acid, nitrogen-containing heterocyclic compounds such as nitrobenzimidazole, nitroindazole, (substituted) benzotriazoles or benzothiazolium salts may be used as anti-ioggants. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines. These mercaptoazoles may also contain a group which confers solubility in water, e.g. a carboxyl group or a sulpho group. Other suitable compounds are published in Research Disclosure No. 17643 (1978), section VI.

The stabilizers may be added to the silver halide emulsions before, during or after ripening. The compounds may, of course, also be added to other photographic layers associated with the silver halide layer.

Mixtures of two or more of the above mentioned compounds may also be used.

The photographic emulsions or other hydrophilic colloid layers of the light sensitive material prepared according to the invention may contain surface active agents for various purposes, for example coating auxiliaries to prevent electric charging, to improve the slip properties, to emulsify the dispersion, to prevent adhesion and to improve the photographic characteristics (e.g. development acceleration, high contrast, sensitization, etc.).

Chemical sensitization may be carried out by means of labile sulphur compounds (e.g. thiosulphate, diacetylthiourea), by gold-sulphur ripening or by reduction ripening. It may be carried out with the addition of Ir, Rh, Pb, Cd, Hg or Au or by the addition of optical sensitizers or stabilizers.

The photographic material may also contain UV-light absorbent compounds, white toners, spacers, formalin acceptors and other substances.

Compounds which absorb UV light are intended to protect the image dyes against bleaching by daylight which has a high UV content and to act as filter dyes by absorbing the UV light in the daylight used for exposure so as to improve the colour reproduction of the film. Compounds with different structures are generally used for the two different functions. Examples of UV light absorbent compounds include aryl-substituted benzotriazole compounds (U.S. Pat. No. 3,533,794), 4thiazolidone compounds (U.S.Pat. No. 3,314,794 and 3,352,681), benzophenone compounds (JP-A No. 2784/71), cinnamic acid ester compounds (U.S. Pat. No. 3,705,805 and 3,707,375), butadiene compounds (U.S. Pat. No. 4,045,229) and benzoxazole compounds (U.S. Pat. No. 3,700,455).

Couplers which absorb ultraviolet light (such as cyan couplers and the α-naphthol series) and polymers which absorb ultraviolet light may also be used. These ultraviolet light absorbents may be fixed in a particular layer by mordanting.

Suitable white toners are described, for example, in Research Disclosure, December 1978, pages 22 et sec, publication 17643, chapter V.

The average particle diameter of the spacers is mainly in the range of from 0.2 to 10 μm. The spacers are water insoluble and may be either soluble or insoluble in alkalis, those which are alkali soluble being generally removed from the photographic material in the alkaline development bath. Examples of suitable polymers include polymethyl methacrylate, copolymers of acrylic acid and methyl methacrylate, and hydroxypropylmethyl cellulose hexahydrophthalate.

The binders of the material according to the invention are hardened with suitable hardeners, especially when gelatine is used as binder. The hardeners used may be, for example, epoxides, ethylene imines, acryloyls or vinyl sulphones. Hardeners of the diazine, triazine and 1,2-dihydroquinoline series are also suitable.

The binders in the material according to the invention are preferably hardened with instant hardeners.

Instant hardeners are compounds which cross-link suitable binders at such a rate that hardening is sufficiently completed immediately after casting or at latest after 24 hours, preferably after not more than 8 hours, to ensure that no further change in sensitometry due to the cross-linking reaction or swelling of the combination of layers will take place. By swelling is meant the difference between the thickness of the wet layer and the thickness of the dry layer when a film is processed under aqueous conditions (Photogr. Sci. Eng. 8 (1964), 275; Photogr. Sci. Eng. (1972), 449).

These hardeners which react very rapidly with gelatine may be, for example, carbamoylpyridinium salts which are capable of reacting with free carboxyl groups in the gelatine so that the latter can react with free amino groups in the gelatine to form peptide bonds which bring about cross-linking.

Examples of suitable instant hardeners include compounds corresponding to the following general formulae:

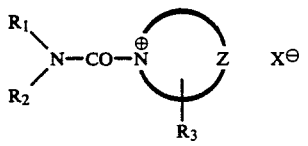

(a)

wherein $R_1$ denotes alkyl aryl or aralkyl, $R_2$ has the same meaning as $R_1$ or denotes alkylene, arylene, aralkylene or alkaralkylene in which the second bond is attached to a group of the formula

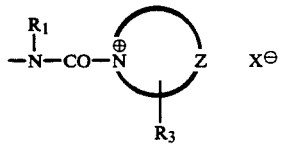

or $R_1$ and $R_2$ together denote the atoms required for completing an optionally substituted heterocyclic ring, for example a piperidine, piperazine or morpholine ring, which ring may be substituted, e.g. by $C_1$ to $C_3$ alkyl or by halogen, $R_3$ denotes hydrogen, alkyl, aralkyl, alkoxy, $—NR_4—COR_5$, $—(CH_2)_m—NR_8R_9$, $—(CH_2)_n—CONR_{13}R_{14}$ or $—(CH_2)_p—CH—Y—R_{16}$ $$—(CH_2)_p—\underset{\underset{R_{15}}{|}}{CH}—Y—R_{16}$$

or a bridging member or a direct link to a polymer chain, and $R_4$, $R_6$, $R_7$, $R_9$, $R_{14}$, $R_{15}$, $R_{17}$, $R_{18}$ and $R_{19}$ denote hydrogen or $C_1$ to $C_4$ alkyl, $R_5$ denotes hydrogen, $C_1$ to $C_4$ alkyl or $NR_6R_7$, $R_8$ denotes $COR_{10}$, $R_{10}$ denotes $NR_{11}R_{12}$ $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m stands for a number from 1 to 3, n stands for a number from 0 to 3, p stands for a number from 2 to 3 and Y denotes 0 or $NR_{17}$ or $R_{13}$ and $R_{14}$ together denote the atoms required for completing an optionally substituted heterocyclic ring, for example a piperidine, piperazine or morpholine ring, which ring may be substituted, e.g. by $C_1$ to $C_3$ alkyl or halogen, Z denotes the carbon atoms required for completing a five membered or six membered aromatic heterocyclic ring, optionally carrying a condensed benzene ring, and $X^{\ominus}$ denotes an anion, which is absent if an anionic group is already attached to the remainder of the molecule;

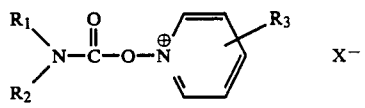

(b)

wherein $R_1$, $R_2$, $R_3$ and $X^{\ominus}$ have the meanings indicated for formula (a).

The materials according to the invention are processed by the recommended methods in the usual manner.

EXAMPLE 1

A silver chlorobromide emulsion prepared by double inflow and partial conversion and containing 15 mol % of chloride and 85 mol % of bromide with an average grain diameter of 0.34 μ and doped with 0.17 μmol of $RhCl_3$ per mol of Ag is ripened to an optimum sensitivity/fog ratio after the addition of 20 μmol of sodium thiosulphate per mol of Ag. The emulsion contains 100 g of $AgNO_3$ per kg.

This emulsion is sensitized with a green sensitizer in the quantity indicated (Table 2) and after the addition of a wetting agent is cast on PE paper in a quantity corresponding to a silver application of 1.4 g per $m^2$.

The material is then subjected to a sensitometric exposure behind a yellow filter and a magenta filter. It is then developed in an Agfa Neutol developer and the differentiation of gradation behind the two filters is determined in logarithmic units (log BU) in terms of the exposure range. The log BU is the exposure range between the resulting blackening densities D=1.7 and D=0.04. The results are summarized in Table 2, in which Column 1: shows the green sensitizer used, Column 2: shows the quantity of green sensitizer in μmol per mol of silver, Column 3: shows the log BU behind the yellow filter, Column 4: shows the log BU behind the magenta filter and Column 5: gives the sensitization maximum in nm.

TABLE 2

| 1 | 2 | 3 | 4 | 5 | |
|---|---|---|---|---|---|
| 3 | 39 | 1.30 | 0.65 | 527 | Invention |
| 3 | 58 | 1.40 | 0.60 | 527 | Invention |
| 3 | 87 | 1.40 | 0.60 | 527 | Invention |
| 3 | 130 | 1.20 | 0.70 | 527 | Invention |
| 5 | 87 | 1.20 | 0.75 | 545 | Invention |
| 2 | 87 | 1.40 | 0.80 | 525 | Invention |
| 1 | 39 | 1.40 | 0.70 | 532 | Invention |
| 1 | 58 | 1.50 | 0.65 | 532 | Invention |
| 1 | 87 | 1.50 | 0.65 | 532 | Invention |
| 3 | 240 | 0.75 | 0.70 | 527 | Comparison |
| 5 | 240 | 0.80 | 0.75 | 545 | Comparison |
| 2 | 240 | 0.80 | 0.80 | 525 | Comparison |
| 1 | 240 | 0.75 | 0.65 | 532 | Comparison |
| A | 39 | 0.85 | 0.70 | 528 | Comparison |
| A | 58 | 0.75 | 0.70 | 528 | Comparison |
| A | 87 | 0.70 | 0.70 | 528 | Comparison |
| B | 39 | 0.75 | 0.70 | 520 | Comparison |
| B | 58 | 0.65 | 0.65 | 520 | Comparison |
| B | 87 | 0.70 | 0.65 | 520 | Comparison |

As may be seen from Table 2, the gradation differentiation for exposure behind yellow filters and magenta filters is very good with the green sensitizers according to the invention and within certain limits is only slightly dependent on the quantity of dye. This differentiation is not obtained when larger quantities are used (in the example of this emulsion, 240 μmol per mol of silver) and when the green sensitizers have a constitution not according to the invention (A or B).

Comparison dye A

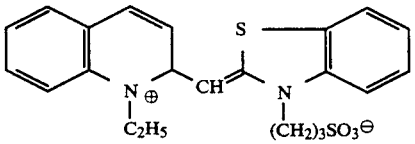

Comparison dye B

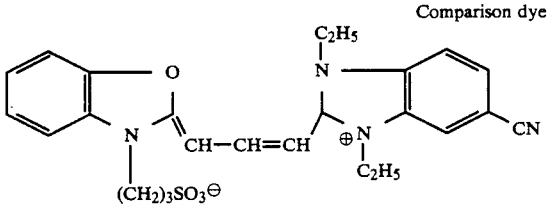

EXAMPLE 2

Example 2 is carried out analogously to Example 1 using a silver chlorobromide emulsion prepared by the Kipp process, containing 27 mol % of bromide and 73 mol % of chloride, grain size 0.3/μ doped with 0.35 μmol of $RhCl_3$ per mol of Ag. The results are shown in Table 3.

Comparison dye C

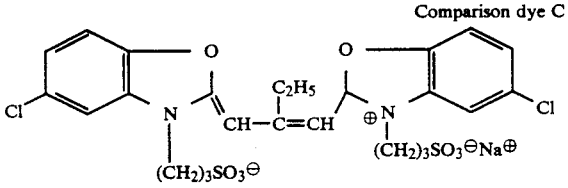

Table 3 shows that with the green sensitizers according to the invention, a gradation differentiation is obtained also with this emulsion with high chloride content whereas no differentiation is obtained with the comparison dyes.

TABLE 3

| 1 | 2 | 3 | 4 | 5 | |
|---|---|---|---|---|---|
| 24 | 75 | 1.10 | 0.60 | 555 | Invention |
| 23 | 75 | 1.40 | 0.60 | 545 | Invention |
| 21 | 75 | 1.30 | 0.55 | 545 | Invention |
| 20 | 75 | 1.25 | 0.60 | 545 | Invention |
| 7 | 75 | 1.25 | 0.70 | 530 | Invention |
| 1 | 71 | 1.40 | 0.60 | 525 | Invention |
| 1 | 89 | 1.35 | 0.60 | 525 | Invention |
| 1 | 107 | 1.20 | 0.65 | 525 | Invention |
| 2 | 75 | 1.50 | 0.70 | 525 | Invention |
| 12 | 75 | 1.30 | 0.65 | 545 | Invention |
| A | 75 | 0.70 | 0.65 | 525 | Comparison |
| B | 75 | 0.75 | 0.70 | 520 | Comparison |
| C | 71 | 0.65 | 0.60 | 520 | Comparison |
| C | 107 | 0.60 | 0.60 | 520 | Comparison |

EXAMPLE 3

The silver chlorobromide emulsions of Examples 1 and 2, referred to in this Example as emulsion 1 and emulsion 2, are sensitized with the green sensitizers according to the invention shown in Table 4 but the given quantity of dye is not added to the whole sample of emulsion but only to the proportion thereof given in column 6 of Table 4 (in percent). The spectrally sensitized portion is digested for 20 minutes at 40° C. and then is added to the non-sensitized remainder of the emulsion sample. The emulsion is then cast and sensitometrically tested as described in Example 1.

Table 4 shows that particularly good differentiation of gradation is obtained by this measure of spectrally sensitizing only part of the emulsion with the dyes according to the invention.

TABLE 4

| 1 | 2 | 3 | 4 | 5 | 6 | Emulsion |
|---|---|---|---|---|---|---|
| 7 | 150 | 1.50 | 0.65 | 530 | 50 | 2 |
| 11 | 75 | 1.30 | 0.75 | 545 | 50 | 2 |
| 12 | 150 | 1.35 | 0.60 | 545 | 50 | 2 |
| 26 | 75 | 1.30 | 0.80 | 545 | 50 | 2 |
| 27 | 75 | 1.15 | 0.60 | 550 | 50 | 2 |
| 28 | 75 | 1.50 | 0.65 | 550 | 50 | 2 |
| 1 | 250 | 1.55 | 0.65 | 525 | 30 | 2 |
| 1 | 150 | 1.45 | 0.65 | 525 | 50 | 2 |
| 3 | 172 | 1.60 | 0.70 | 527 | 50 | 1 |
| 1 | 261 | 1.50 | 0.70 | 532 | 33 | 1 |
| 1 | 174 | 1.50 | 0.70 | 532 | 50 | 1 |
| 1 | 116 | 1.40 | 0.70 | 532 | 75 | 1 |
| 24 | 175 | 1.20 | 0.70 | 560 | 50 | 1 |
| 25 | 175 | 1.20 | 0.80 | 520 | 50 | 1 |

EXAMPLE 4

The emulsion samples of Example 3 were repeated but in this case 50% of the emulsion was green sensitized in accordance with the invention and 50% was sensitized to the blue region of the spectrum by the addition of a blue sensitizer. Casting and sensitometric examination were carried out as described. The blue sensitization increased the blue sensitivity behind the magenta filter and thereby reduced the difference between the blue sensitivity and the high green sensitivity which is obtained with the green sensitizers according to the invention.

The results for the samples are entered in Tables 5 and 6, the various columns containing the following entries:

1. The green sensitizer.
2. The quantity of green sensitizer in μmol per mol of Ag.
3. Blue sensitizer BS.
4. Quantity of blue sensitizer in μmol per mol of Ag.
5. Log BU behind yellow filter.
6. Log BU behind magenta filter.
7. Relative sensitivity behind magenta filter.

TABLE 5

| Emulsion 2 from Example 3 | | | | | | |
|---|---|---|---|---|---|---|
| 1 | 2 | 3 | 4 | 5 | 6 | 7 |
| 1 | 89 | — | — | 1.45 | 0.65 | 100 |
| 1 | 89 | BS 6 | 40 | 1.40 | 0.60 | 180 |
| 1 | 89 | BS 4 | 40 | 1.45 | 0.55 | 215 |
| 1 | 89 | BS 8 | 40 | 1.35 | 0.60 | 255 |
| 1 | 89 | BS 1 | 20 | 1.35 | 0.65 | 220 |

TABLE 6

| Emulsion 1 from Example 3 | | | | | | |
|---|---|---|---|---|---|---|
| 1 | 2 | 3 | 4 | 5 | 6 | 7 |
| 3 | 86 | — | — | 1.60 | 0.70 | 100 |

TABLE 6-continued

| Emulsion 1 from Example 3 | | | | | | |
|---|---|---|---|---|---|---|
| 1 | 2 | 3 | 4 | 5 | 6 | 7 |
| 3 | 86 | BS 6 | 90 | 1.55 | 0.70 | 170 |
| 3 | 86 | BS 4 | 90 | 1.50 | 0.75 | 160 |
| 3 | 86 | BS 1 | 75 | 1.45 | 0.70 | 195 |

We claim:

1. Gradation variable black and white paper containing a light sensitive silver halide emulsion layer, characterized in that 20 to 80% by weight of the silver halide is green sensitized with a compound corresponding to the following formula:

(I)

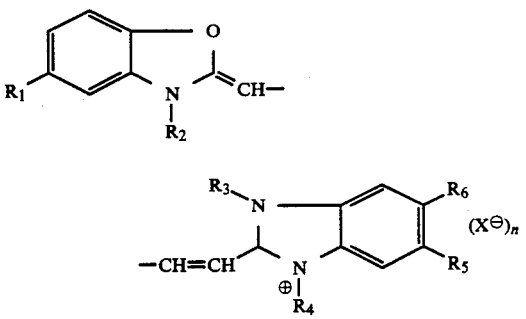

wherein $R_1$ denotes chlorine, $R_2$ denotes alkyl, sulphoalkyl or carboxyalkyl, $R_3$ denotes alkyl, hydroxyalkyl or acyloxyalkyl, $R_4$ denotes alkyl, sulphoalkyl or carboxyalkyl, $R_5$ denotes chlorine, $R_6$ denotes hydrogen or $R_5$, $X^{\theta}$ denotes an anion and n stands for 0 or 1, and n stands for 0 when one of the groups denoted by $R_2$ or $R_4$ is sulphoalkyl or carboxyalkyl and n stands for 1 when neither of the groups denoted by $R_2$ and $R_4$ is sulphoalkyl or carboxyalkyl, in a quantity of from $$\frac{10}{\bar{d}} \text{ to } \frac{80}{\bar{d}} \ \mu\text{mol/mol}$$

of silver halide $\bar{d}$ being the average grain diameter of the silver halide in μm.

2. Gradation variable black-and-white paper according to claim 1, characterised in that tue silver halide emulsion layer contains a mixture of from 40 to 85% by weight of emulsion which has been green sensitized according to claim 6 and from 15 to 60% by weight of blue sensitized emulsion.

3. Gradation variable black-and-white paper according to claim 1, characterised in that the average grain size of the silver halide grains is from 0.2 to 0 6 μm.

4. Gradation variable black-and-white paper according to claim 1, characterised in that the silver halide of the silver halide emulsion layer is composed of 20 to 80 mol % of AgBr, 80 to 20 mol % of AgCl and 0 to 5 mol % of AgI.

* * * * *